US008789292B2

(12) United States Patent
Ludemann et al.

(10) Patent No.: US 8,789,292 B2
(45) Date of Patent: Jul. 29, 2014

(54) FOOTWEAR ASSEMBLIES HAVING REINFORCED INSOLE PORTIONS AND ASSOCIATED METHODS

(75) Inventors: John W. Ludemann, Canby, OR (US); Michael K. Buzon, Lake Oswego, OR (US); Aaron Barker, Portland, OR (US)

(73) Assignee: LaCrosse Footware, Inc., Portland, OR (US)

( * ) Notice: Subject to any disclaimer, the term of this patent is extended or adjusted under 35 U.S.C. 154(b) by 632 days.

(21) Appl. No.: 13/110,739

(22) Filed: May 18, 2011

(65) Prior Publication Data

US 2012/0291309 A1 Nov. 22, 2012

(51) Int. Cl.

| | |
|---|---|
| ***A43B 9/00*** | (2006.01) |
| ***A43B 7/14*** | (2006.01) |
| ***A43B 9/02*** | (2006.01) |
| ***A43B 9/12*** | (2006.01) |

(52) U.S. Cl.

CPC . *A43B 7/144* (2013.01); *A43B 9/02* (2013.01); *A43B 9/12* (2013.01); *A43B 7/148* (2013.01)

USPC ..... 36/12; 36/19 R; 36/21

(58) Field of Classification Search

CPC ..... A43B 9/00; A43B 9/02; A43B 9/08; A43B 9/10; A43B 23/08

USPC ..... 36/12, 19 R, 21, 69

See application file for complete search history.

(56) References Cited

U.S. PATENT DOCUMENTS

| | | | | |
|---|---|---|---|---|
| 392,677 | A | 11/1888 | King | |
| 406,338 | A | 7/1889 | Cross | |
| 1,602,675 | A | 10/1926 | Hurley | |
| 1,709,735 | A | 4/1929 | Parlante | |
| 1,764,105 | A * | 6/1930 | Jung | 12/142 C |
| 2,005,048 | A | 6/1935 | Randall | |
| 2,038,528 | A | 4/1936 | McCarthy | |
| 2,446,357 | A * | 8/1948 | Vigorith | 36/19 A |
| 3,152,407 | A * | 10/1964 | Richards | 36/19 R |
| 4,001,954 | A * | 1/1977 | Taylor, Jr. | 36/16 |
| 4,182,055 | A * | 1/1980 | Turner, Jr. | 36/30 R |
| 4,852,275 | A * | 8/1989 | Bianchini et al. | 36/102 |
| 4,869,001 | A | 9/1989 | Brown | |
| 4,918,776 | A | 4/1990 | Motoda et al. | |
| 5,729,918 | A | 3/1998 | Smets | |
| 5,933,896 | A | 8/1999 | Gallina et al. | |
| 6,029,301 | A * | 2/2000 | Issler et al. | 12/142 B |
| 6,055,745 | A | 5/2000 | Endoh et al. | |
| 6,484,420 | B1 | 11/2002 | Chi et al. | |
| 6,757,990 | B2 * | 7/2004 | Chi et al. | 36/12 |
| 6,834,408 | B1 * | 12/2004 | Chen | 12/142 T |

(Continued)

OTHER PUBLICATIONS

ARS sutoria, Issue 114, p. 27, Dec.1975, Milan, Italy.

(Continued)

*Primary Examiner* — Marie Bays

(74) *Attorney, Agent, or Firm* — Perkins Coie LLP

(57) ABSTRACT

Footwear assemblies including reinforced insole portions and associated methods of use and manufacture are disclosed herein. In one embodiment, a footwear assembly includes an upper coupled to an insole. The insole includes a first surface opposite a second surface. The first surface is configured to face a user's foot when inserted in the upper. The upper at least partially wraps around and is stitched directly to the second surface of the insole. The footwear assembly further includes a midsole adjacent to the second surface of the insole, and an outsole adjacent to the midsole.

18 Claims, 5 Drawing Sheets

(56) References Cited

U.S. PATENT DOCUMENTS

| | | | | |
|---|---|---|---|---|
| 6,941,682 | B2 | 9/2005 | Chi et al. | |
| 7,322,128 | B2 * | 1/2008 | Issler | 36/21 |
| 2003/0005598 | A1 * | 1/2003 | Chi et al. | 36/12 |
| 2003/0182822 | A1 * | 10/2003 | Chen | 36/92 |
| 2004/0244128 | A1 * | 12/2004 | Chen | 12/142 B |

OTHER PUBLICATIONS

ARS sutoria, Issue 211, p. 148, Jun. 1991, Milan, Italy.
ARS sutoria, Issue 223, p. 165, Jan. 1993, Milan Italy.
ARS sutoria, Issue 235, p. 209 Jun. 1994, Milan, Italy.
ARS sutoria, Issue 84, p. 88-89, Mar. 1969, Milan Italy.
ARS sutoria, De Grande Produzoine, p. 149, Milan, Italy.
Foto Shoe, Calza® natura Stepper, Stilman, Feb. 2, 1991.
Foto Shoe, Calza®—natura Stepper, Stilman S.p.A.; Dandy Boot®, Lavorazione Artigiana, Aug. 8, 1990.
Rockport ProWalker Brochere, "The ProWalker 7000," 1978, Rockport Walking Institute, Marlboro, Massachusetts.
Danner—Spring 2000 Catalog, Danner, Inc., published at least as early as Aug. 1, 1999, 36 pages.
Danner Radical—Spring 2000 Sales Video (Transcript), Danner, Inc., published at least as early as Aug. 1, 1999, 2 pages.

* cited by examiner

FOOTWEAR ASSEMBLIES HAVING REINFORCED INSOLE PORTIONS AND ASSOCIATED METHODS

TECHNICAL FIELD

The present disclosure is directed generally to footwear assemblies having insoles securely attached to corresponding uppers and midsole and/or outsoles.

BACKGROUND

Articles of footwear have been designed for in a wide variety of physical activities including walking, running, hiking, trekking, hunting, backpacking, and indoor and outdoor activities. For example, hiking and work boots are typically designed to provide a wearer with suitable comfort and support for hiking or walking on uneven or rough terrain. Conventional hiking or work boots, however, can be relatively heavy. Every time a wearer takes a step, such as while walking or hiking, the wearer must lift the weight of the boot. After hundreds or thousands of steps, that additional weight can be fatiguing on the wearer's legs. Accordingly, it is highly desirable to minimize the weight of the footwear without overly compromising the stability and support of the footwear.

U.S. Pat. Nos. 6,484,420 and 6,757,990 disclose a significant advancement in footwear technology to achieve a lightweight footwear assembly while maintaining a very stable platform. U.S. Pat. Nos. 6,484,420 and 6,757,990 are incorporated herein in their entirety by reference. This footwear incorporates a construction wherein at least a portion of the lateral and medial peripheral flanges of the upper are stitched to the insole in the phalangeal and heel portions but they are not stitched to the insole through the arch portion. Additionally, the lateral and medial peripheral flange of the upper is wrapped around the lateral peripheral edge of the insole in the arch portion and the medial peripheral flange of the upper is wrapped around the medial peripheral edge of the insole in the arch portion. Moreover, the lateral and medial peripheral flanges are secured to the bottom surface of the arch portion of the insole. This construction provides a very lightweight and stable platform, although there are areas where improvements may be made for selected footwear.

DETAILED DESCRIPTION

Figure 1:
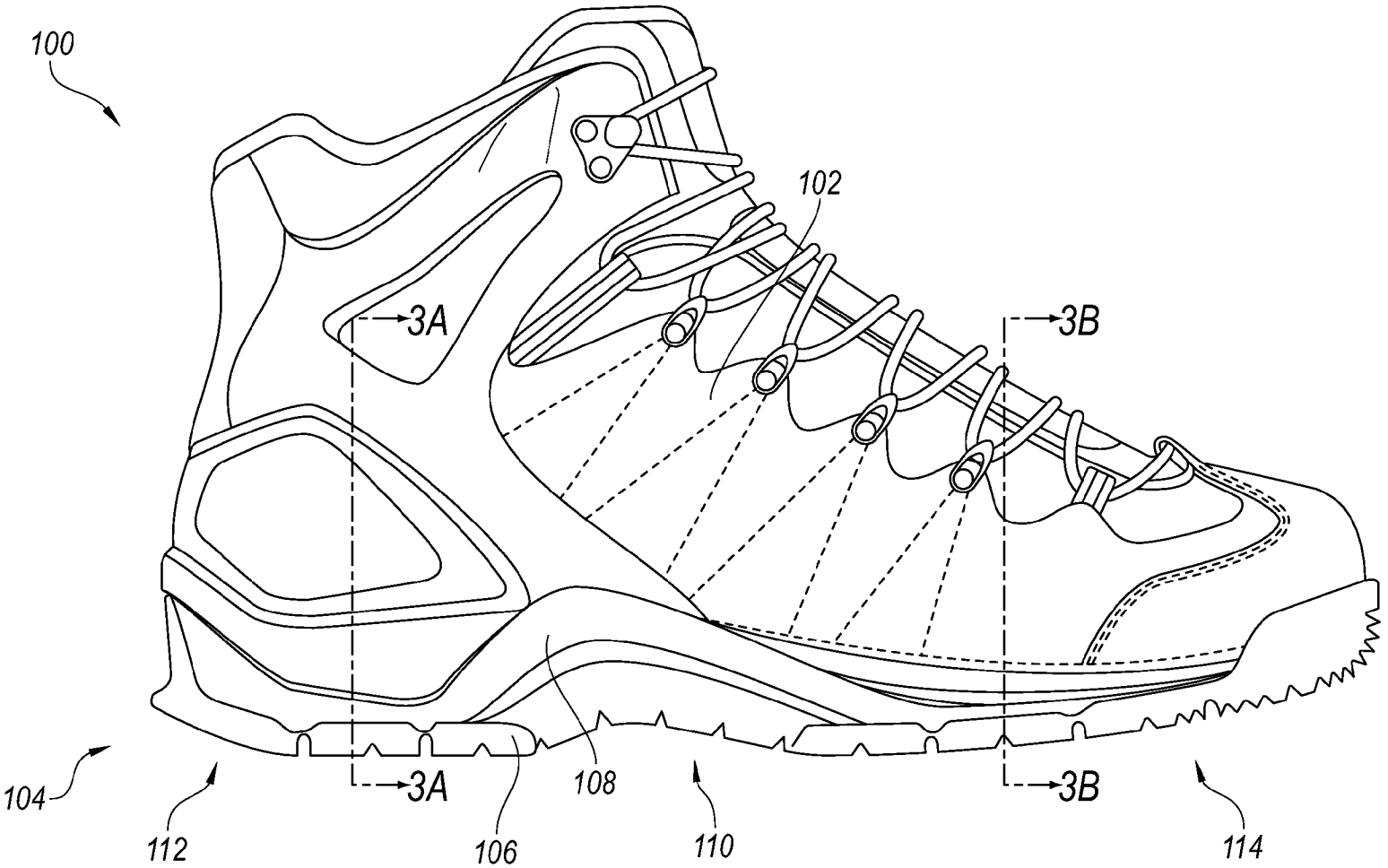
FIG. 1 is a side view of a footwear assembly configured in accordance with an embodiment of the disclosure.

Footwear assemblies with securely attached and reinforced insoles, and associated methods for using and making such assemblies, are described in detail herein in accordance with embodiments of the present disclosure. In one embodiment, for example, a footwear assembly includes an upper coupled to a multi-piece insole having a first insole board positioned underneath and attached to a second insole board in the heel area of the footwear. The first insole board includes a first surface (e.g., a top surface) opposite a second surface (e.g., a bottom surface). The top surface is configured to face the second insole board and a user's foot when inserted in the upper. In the heel area, the peripheral portion of the upper at least partially wraps around the edge of the first insole board and is stitched to the bottom surface of the first insole board. The second insole board is stacked on top of at least a portion of the first insole board in the heel area. In one embodiment, the peripheral edge portion of the upper in the heel area is wrapped around and stitched to the first insole board, but the stitching does not extend through the second insole board. Instead, the heel area of the second insole board is adhered or otherwise anchored to the top surface of the first insole board, to which the upper is stitched. Moreover, at the arch area, the peripheral portion of the upper is wrapped around and adhered to the bottom surface of the first or second insole boards, such that stitching along the upper does not extend into the arch area of the footwear.

In one embodiment, a heel counter is provided in the heel area of the footwear. A bottom flange portion of the heel counter is sandwiched between at least the peripheral areas of the first and second insole boards. Sidewalls of the heel counter extend upwardly from the bottom flange portion and help define a heel cup area in the footwear. In at least one embodiment, the flange of the heel cup can be adhered to the top of the first insole board. In another embodiment, the flange of the heel cup can be stitched to the top of the first insole board with the same stitching that secures the peripheral edge portion of the upper to the bottom surface of the first insole board. Moreover, at the forefoot area, the peripheral edge portions of the upper are flared outwardly and stitched to the upper surface of the second insole board forward of the arch area, but not in the arch area.

In another embodiment, a footwear assembly includes an upper, a sole assembly including an insole and a midsole, and an outsole. The insole is positioned between the upper and the midsole, and the midsole is positioned between the insole and the outsole. The upper is coupled to the sole assembly. At a heel portion of the footwear assembly, a lower edge portion of the upper is stitched to a lower surface of the insole facing the midsole. At a forefoot portion of the footwear assembly, the lower edge portion of the upper is stitched to an upper surface of the insole opposite the midsole. Moreover, the upper is not stitched to the insole at an arch portion of the footwear assembly.

Certain details are set forth in the following description and in FIGS. 1-4 to provide a thorough and enabling description of various embodiments of the disclosure. Other details describing well-known structures and components often associated with footwear assemblies and methods of forming such assemblies, however, are not set forth below to avoid unnecessarily obscuring the description of various embodiments of the disclosure. Many of the details, dimensions, angles, relative sizes of components, and/or other features shown in the Figures are merely illustrative of particular embodiments of the disclosure. Accordingly, other embodiments can have other details, dimensions, angles, sizes, and/or features without departing from the spirit and scope of the present disclosure. In addition, further embodiments of the disclosure may be practiced without several of the details described below, while still other embodiments of the disclosure may be practiced with additional details and/or features. In the Figures, identical reference numbers identify identical, or at least generally similar, elements. To facilitate the discussion of any particular element, the most significant digit or digits of any reference number refer to the Figure in which that element is first introduced. For example, element 100 is first introduced and discussed with reference to FIG. 1. Moreover, one of ordinary skill in the art will appreciate that any relative positional terms such as above, below, over, under, etc. do not necessarily require a specific orientation of the footwear assemblies as described herein. Rather, these or similar terms are intended to describe the relative position of various features of the disclosure described herein.

FIG. 1 is a side view of a footwear assembly 100 ("assembly 100") configured in accordance with an embodiment of the disclosure. As will be appreciated by one of ordinary skill in the art, the assembly 100 can include any article of footwear (e.g., a boot, shoe, sandal, etc.) and is not limited to the boot shown in FIG. 1. In the illustrated embodiment, the assembly 100 includes an upper 102 attached to a sole assembly 104. The sole assembly 104 includes an outsole 106 coupled to a midsole 108, as well as an insole attached to the upper 102 and the midsole 108 as described in detail below with reference to FIGS. 2-4. The sole assembly 104 also includes an arch portion 110 positioned between a heel portion 112 and a forefoot portion 114. As described in detail below, the sole assembly 104, and in particular the heel portion 112 of the sole assembly 104, is configured to provide increased support and stability, as well as secure attachment to the upper 102.

Figure 2:
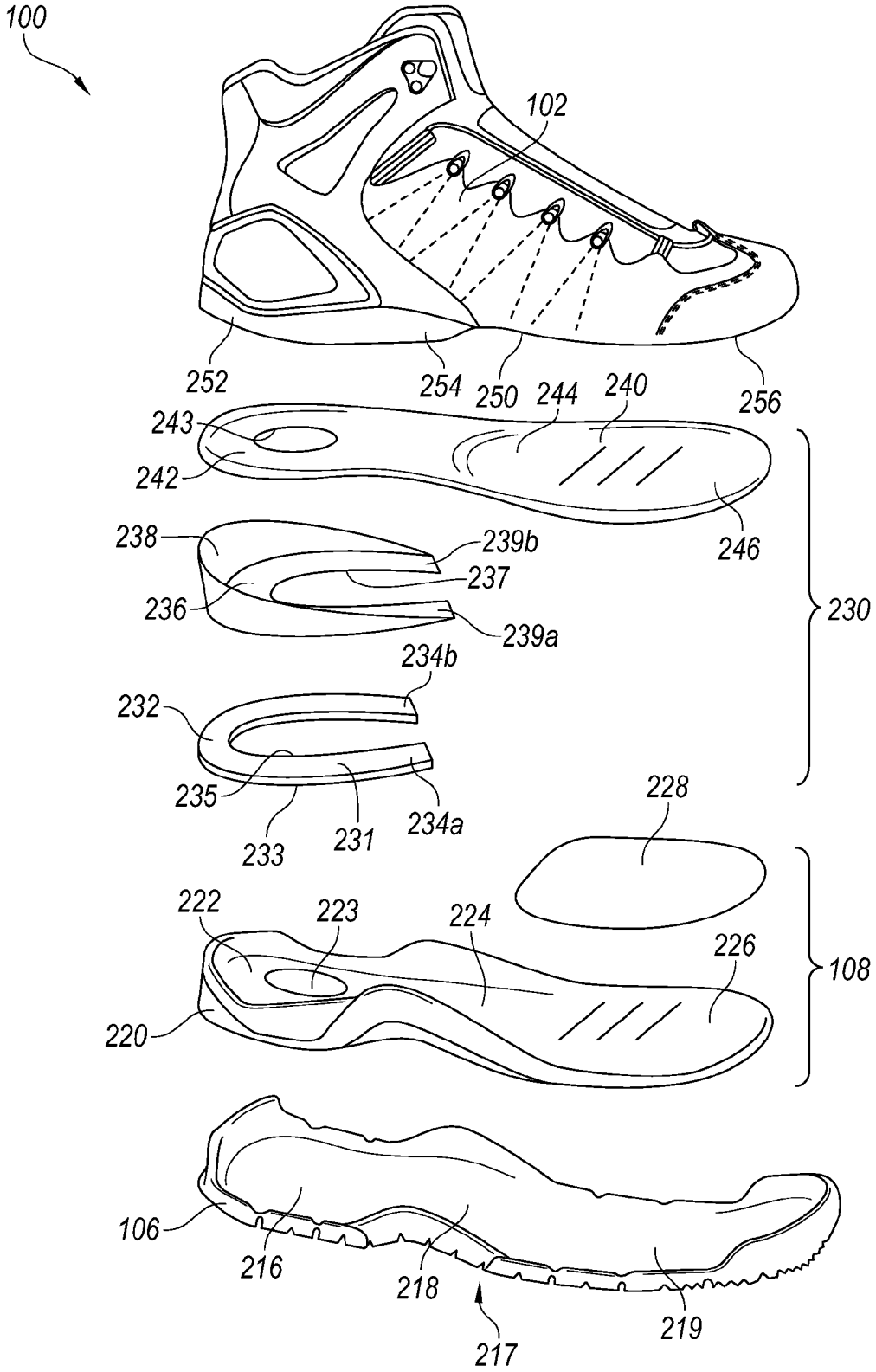
FIG. 2 is an isometric partially exploded view of the footwear assembly of FIG. 1.

FIG. 2 is an isometric partially exploded view of the footwear assembly 100 of FIG. 1 illustrating several features of the sole assembly 104. More specifically, the sole assembly 104 includes the outsole 106 coupled to the midsole 108, as well as the insole 230 and upper 102 coupled to the midsole 108. In the illustrated embodiment, the outsole 106 includes an outsole arch portion 218 between an outsole heel portion 216 and an outsole forefoot portion 219. The outsole 106 also includes an exterior tread portion 217 that can include any suitable tread pattern for providing traction while walking or running on various terrain. The outsole 106 can be made from rubber (e.g., natural or synthetic), leather, or other suitable footwear materials or combinations of materials.

According to additional features of the illustrated embodiment, the midsole 108 is positioned adjacent to the outsole 106 and includes a full-length first midsole portion 220 and a separate second midsole portion 228. The first midsole portion 220 includes an arch portion 224 between a heel portion 222 and a forefoot portion 226. The first midsole's heel portion 222 can include a cushioned heel section 223 that provides additional support or cushioning in the heel portion 222. For example, the cushioned heel section 223 can be made from the same material or a different material from the first midsole heel portion 222, and can protrude or extend away from the first midsole heel portion 222 to provide an increased thickness. In other embodiments, however, the cushioned heel section 223 can be omitted.

The second midsole portion 228 is configured to be generally aligned with or otherwise overlap the first midsole forefoot portion 226 of the first midsole portion 220 to provide additional support and/or cushioning at the first midsole forefoot portion 226. Although the first and second midsole portions 220, 228 are shown as separate components, in other embodiments these portions of the midsole 108 can be integrally formed. Moreover, in still further embodiments, the midsole 108 can be integrally formed with the outsole 106 or omitted from the sole assembly 104. The midsole 108 can be formed from rubber, ethylene vinyl acetate (EVA), closed-cell foam material, and/or other suitable footwear materials. As such, the midsole 108 can provide support and comfort while for a user by dispersing the user's weight and providing stability and/or shock absorption.

The insole 230 is positioned adjacent to the midsole 108 and configured to be positioned directly below a users foot when inserted into the assembly 100. In the illustrated embodiment, the insole 230 is a multi-piece insole that includes first and second insole boards 232 and 240, respectively. In the illustrated embodiment, a sturdy heel counter 236 is provided in the heel area and is at least partially sandwiched between the first and second insole boards 232 and 240. The first insole board 232 is configured to be positioned in the heel area of the assembly 100 and includes a generally U-shaped configuration. More specifically, the first insole board 232 can be a stiffener or support that includes a first or lower surface 233 opposite a second or upper surface 231. The lower surface 233 faces the midsole 108 and/or outsole 106, and the upper surface 231 faces the heel counter 236. The first insole board 232 further includes a first insole inner opening 235 at least partially defined between corresponding legs or end portions 234 of the U-shaped configuration (identified individually as a first leg 234*a* and a second leg 234*b*). In other embodiments, however, the inner opening 235 of the first insole board 232 can be smaller or fully enclosed. In still further embodiments, the first insole board 232 can be a structure without any interior opening.

The heel counter 236 is a separate structure positioned adjacent to the upper surface 231 of the first insole board 232 and attached to the first insole board 232. The heel counter 236 is configured to provide stiffness and/or support in the heel area of the assembly 100. For example, the heel counter 236 can be a heel cup structure including a tapered sidewall 238 extending at least partially around rear and side sections of the heel counter 236. The heel counter 236 can be an internal heel counter covered by the heel portion of the upper. In another embodiment, the heel counter 236 can be an external heel counter forming an exterior heel portion of the footwear, such that the external heel counter is visible. In yet another embodiment, the heel counter 236 can be a multi piece structure including an internal heel counter and a separate external counter. In the illustrated embodiment the heel counter 236 is an internal heel counter having a generally U-shaped configuration substantially matching and aligned with the U-shaped first insole board 232. More specifically, for example, the heel counter 236 can include a second insole inner opening 237 at least partially defined between corresponding legs or end portions 239 (identified individually as a first leg 239*a* and a second leg 239*b*). In other embodiments, however, the second insole inner opening 237 of the can be smaller or fully enclosed. In still further embodiments, the heel counter 236 can be a structure without any interior opening.

The second insole board 240 of the illustrated embodiment is a full-length insole component configured to provide added support. The second insole board 240 includes an arch portion 244 positioned between a forefoot portion 246 and a heel portion 242. In certain embodiments, the heel portion 242 of the second insole board 240 can include an opening 243 sized generally similar to and aligned with the inner openings 235, 237 of the first insole portions 232 and the heel counter 236, respectively. As such, these openings in each of the portions of the insole 230 can at least partially surround the cushioned section 223 of the first midsole heel portion 222 in the midsole 108. More specifically, the cushioned section 223 of the midsole 108 projecting from the first midsole heel portion 222 can at least partially extend through the corresponding openings 235, 237, and/or 243 in the insole 230. In other embodiments, however, the cushioned section 223 and the corresponding openings in the insole 230 can be removed from the assembly 100 (e.g., the first and second insole boards 232, 240 can be a structure without an interior opening). Moreover, in certain embodiments the first, second, and/or third portions 232, 236, and 240 of the insole 230 can be made from paper board, non-woven board, plastic, thermoplastic polyurethane (TPU), and/or other materials suitable for an insole in a footwear assembly.

According to additional features of the illustrated embodiment, the upper 102 includes a peripheral edge portion 250 extending around a lower section of the upper 102. The upper 102 also includes an arch portion 254 between a heel portion 252 and a forefoot portion 256. As described in detail below, the peripheral edge portion 250 of the upper 102 is configured to be securely attached to the insole 230.

Figure 3A:
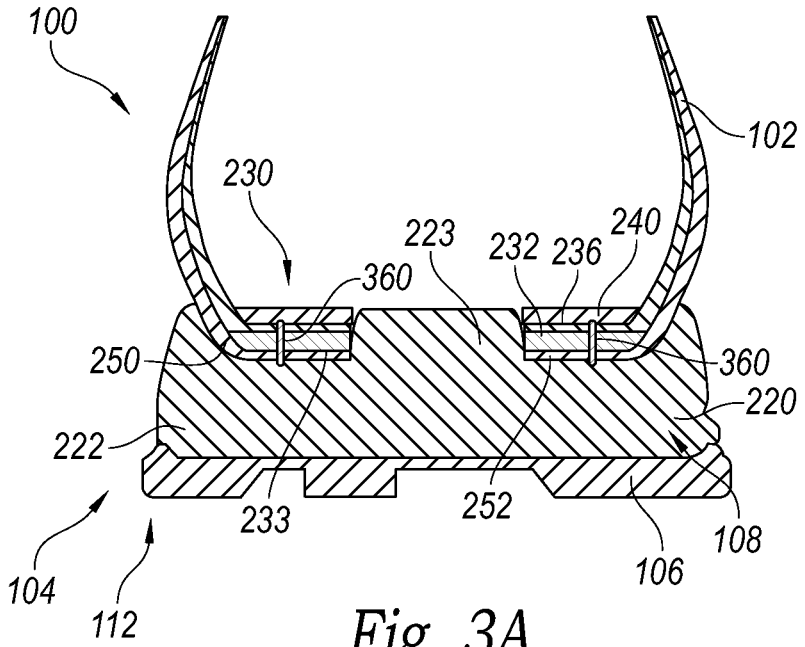
FIG. 3A is a cross-sectional end view taken substantially along lines 3A-3A of FIG. 1.

FIG. 3A is a cross-sectional end view of the assembly 100 taken substantially along lines 3A-3A of FIG. 1 and illustrating several features of the heel portion 112 of the sole assembly 104. According to features of the embodiment illustrated in FIG. 3A, the outsole 106 is secured (e.g., adhered) directly to the midsole 108, the midsole 108 is secured (e.g., adhered) directly to each of the insole 230 and the upper 102. In addition, the insole 230 is also secured (e.g., stitched and/or adhered) directly to the upper 102. More specifically, the heel portion 252 of the upper's peripheral edge portion 250 is positioned between the first insole board 232 of the insole 230 and the first midsole portion 220 of the midsole 108.

As also shown in the illustrated embodiment, the heel portion 252 of the upper peripheral edge portion 250 is stitched, sewn, or otherwise directly attached to the insole 230. In particular, the heel portion 252 at least partially wraps inwardly around the edges of the first insole board 232 and is stitched or sewn directly to each of the first insole board 232. In one embodiment shown in FIG. 3C, the bottom flange of the heel counter 236 is cemented to the top surface of the first insole board. In another embodiment, the bottom flange of the heel counter 236 is stitched to the first insole board 232 and to the heel portion 252 of the upper peripheral edge portion 250 with the heel portion stitching 360. As such, the heel portion 252 of the upper peripheral edge portion 250 is positioned immediately adjacent to the lower surface 233 of the first insole board 232. The upper peripheral edge portion 250 is also sewn or stitched directly to at least the first insole board 232 and optionally to the heel counter 236 with the heel portion stitching 360. Accordingly, the upper peripheral edge portion 250 is positioned beneath the first insole board 232, and the heel portion stitching 360 attaches the heel portion 252 of the upper peripheral edge portion 250 to each of the first insole board 232 (and optionally the heel counter 236). Moreover, the heel portion stitching 360 is not externally visible at the heel portion 112 of the assembly 100. Wrapping the upper peripheral edge portion 250 around the lower surface 233 of the first insole board 232, as well as applying the heel portion stitching 360 to the upper peripheral edge portion 250 and the first insole board 232, helps maintain the structural stability of the overall footwear assembly 100.

In the illustrated embodiment showing the internal heel counter 236, the first insole board 232 is sandwiched between and stitched or otherwise attached to the bottom flange of the internal heel counter and the upper peripheral edge portion 250. In an embodiment wherein the heel counter 236 is an external heel counter, the bottom flange of the heel counter is under the upper peripheral edge portion 250 such that the upper peripheral edge portion 250 is sandwiched between and stitched to the heel counter and the first insole board 232. In another embodiment wherein the heel counter 236 includes an internal heel counter and an external heel counter, the bottom flange of the external heel counter is below and stitched to the upper peripheral edge portion 250 and to the first insole board 232. The stitching can also extend through the bottom flange of the internal heel counter. Alternatively, the internal heel counter can be adhered, bonded, or otherwise securely fixed to the top of first insole board. In yet another embodiment, the internal heel counter can be stitched to the first insole board 232 and the upper peripheral edge portion 250 as shown in FIG. 3A, and the external heel counter may be adhered, bonded, or otherwise securely fixed in place below the first insole board.

According to additional features of the illustrated embodiment, the upper peripheral edge portion 250 is not stitched or sewn directly to the second insole board 240 in the heel portion 112 of the sole assembly 104, nor is the upper peripheral edge portion 250 stitched or sewn directly to the midsole 108 in the heel portion 112 of the sole assembly 104. Instead, the second insole board 240 can be glued or otherwise adhered to the first insole board 232 and/or the heel counter 236. Moreover, and as explained below with reference to FIG. 4, the upper peripheral edge portion 250 is not stitched to the arch portion of the footwear assembly 100. Rather, the upper peripheral edge portion 250 can at least partially wrap inwardly around the arch portion and be glued or otherwise adhered to the arch portion of the insole 230 and/or the midsole 108. In this manner, the attachment of the upper 102 to the insole 230 and the midsole 108 can help to maintain the heel cup configuration while maintaining the structural stability of the components of the overall platform.

According to additional features of the embodiment illustrated in FIG. 3A, the midsole 108 extends at least partially through a portion of the insole 230. More specifically, the cushioned heel section 223 of the first midsole heel portion 222 of the first midsole portion 220 extends through at least a portion of the corresponding openings of each of the first and second insole boards 232 and 240, as well as the heel counter 238. As such, the insole 230 can at least partially surrounds the cushioned portion 233 of the first midsole heel portion 222. In other embodiments and as noted above, the cushioned portion 233 of the midsole 108 can be omitted.

Figure 3B:
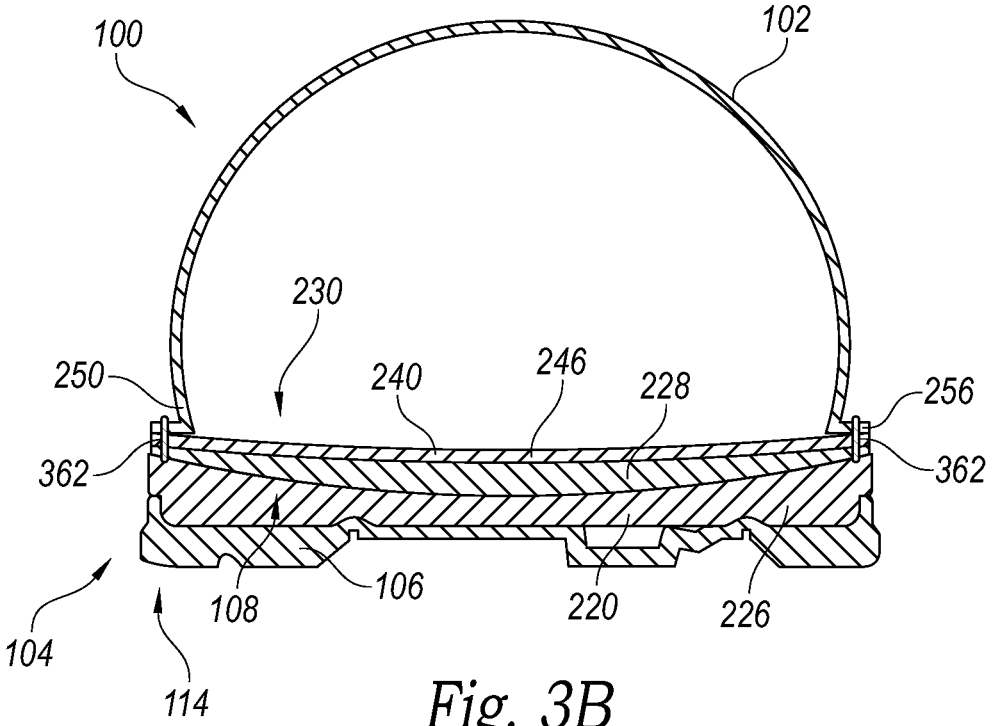
FIG. 3B is a cross-sectional end view taken substantially along lines 3B-3B of FIG. 1.
Figure 3C:
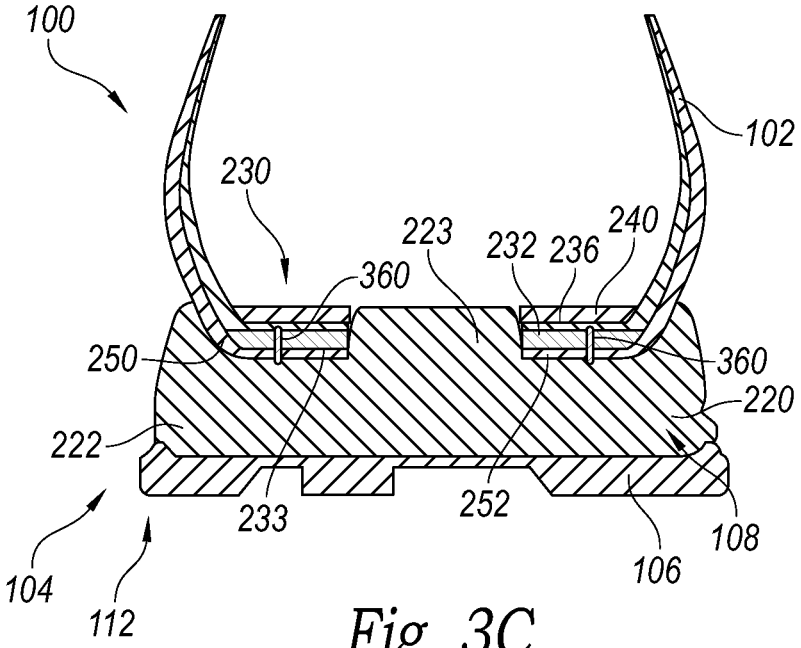
FIG. 3C is a cross-sectional end view similar to FIG. 3A showing an alternate embodiment.

FIG. 3B is a cross-sectional end view of the assembly 100 taken substantially along lines 3B-3B of FIG. 1 and illustrating several features of the forefoot portion 114 of the sole assembly 104. For example, as shown in FIG. 3B, the outsole 106 is secured (e.g., adhered) directly to the midsole 108, and each of the midsole 108 and the insole 230 is secured (e.g., adhered and/or stitched) to the upper 102. More specifically, the forefoot portion 256 of the upper peripheral edge portion 250 flares outwardly and is stitched to the top surface of the second insole board 240. For instance, as shown in FIG. 3B, the upper peripheral edge portion 250 is positioned over corresponding peripheries of the forefoot portion 246 of the second insole board 240, as well as the second midsole portion 228 and the forefoot portion 226 of the first midsole portion 220.

Moreover, the forefoot portion 256 of the upper peripheral edge portion 250 is stitched, sewn, or otherwise directly attached to the insole 230 and the midsole 108 with the forefoot portion stitching 362. In particular, the forefoot portion 256 is sewn or stitched directly to the top surface of the second insole board 240, as well as to the second midsole portion 236. Accordingly, in the illustrated embodiment the forefoot portion stitching 362 is sewn or otherwise applied to each of the upper peripheral edge portion 250, the second insole board 240, and the second midsole portion 228. The forefoot portion stitching 362, however, is not applied to the arch portion 244 of the second insole board 240. Moreover, the upper peripheral edge portion 250 is not stitched or sewn directly to the first midsole portion 226 in the forefoot portion 114 of the sole assembly 104. In addition, the forefoot portion stitching 362 may be externally visible at the forefoot portion 114 of the assembly 100, over the outwardly flared forefoot portion 256 of the upper peripheral edge portion 250 at the top or upper surface of the second insole board 240.

Figure 4:
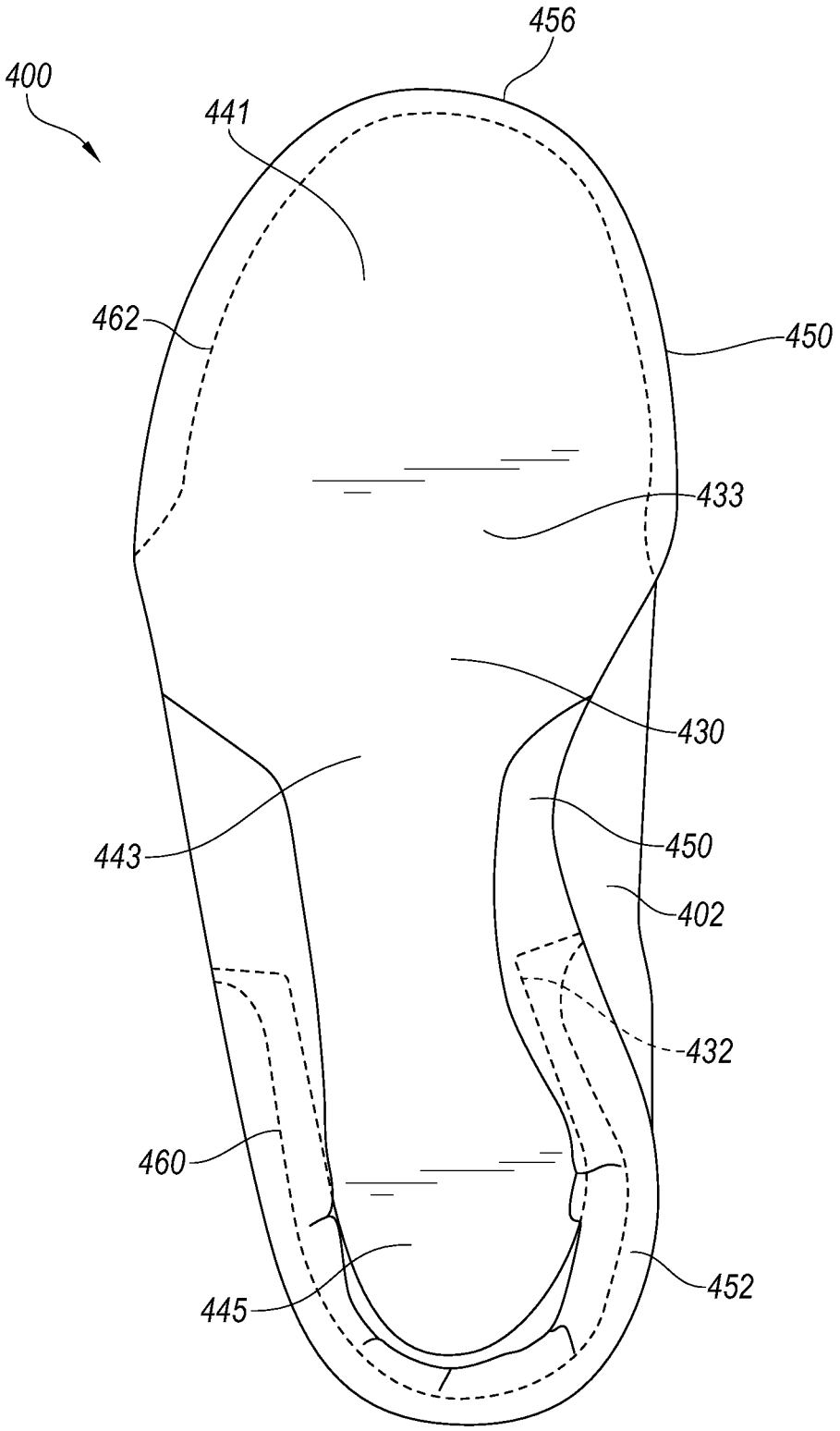
FIG. 4 is a bottom view of a portion of a footwear assembly configured in accordance with another embodiment of the disclosure.

FIG. 4 is a bottom view of a portion of a footwear assembly 400 ("assembly 400") configured in accordance with another embodiment of the disclosure. The assembly 400 includes several features generally similar in structure and function to the corresponding features of the assembly 100 described above with reference to FIGS. 1-3. For example, the assembly 400 illustrated in FIG. 4 includes an upper 402 coupled to a generally U-shaped first insole board 423 and a second insole 430 that extends between the heel and toe areas. The upper 402 and the first and/or second insole boards 432 and 430 are configured to be coupled to a suitable midsole and/or outsole assembly, such as the midsole 108 and outsole 106 described above with reference to FIGS. 1-3C.

In the embodiment illustrated in FIG. 4, however, a corresponding midsole and/or outsole have been removed from the assembly 400 to illustrate several features of a lower or bottom surfaces 433 of the first and second insole boards 432 and 430. As also shown in FIG. 4, the first insole board 432 is a U-shaped structure stitched to the upper in the heel portion of the footwear, and the second insole board 430 is a substantially full length component having an arch insole portion 443 positioned between an insole forefoot portion 441 and an insole heel portion 445. Although not shown in FIG. 4, in other embodiments the insole 430 can include one or more openings to accommodate additional features of a sole assembly, such as cushioning features or other desired features.

As shown in FIG. 4, the upper 402 includes a peripheral edge portion 450 extending around a lower section of the upper 402. The peripheral edge portion 450 includes a heel portion 452 and a forefoot portion 456. The heel portion 452 extends over and at least partially wraps inwardly around at least a portion of the lower surface of the insole heel portions 445 of at least the first insole board 432. The forefoot portion 456 of the peripheral edge portion 450, however, flares outwardly and is stitched or otherwise coupled to a top or upper surface of the forefoot portion 441 of the second insole board 430. As such, the peripheral edge portion 450 of the forefoot portion 456 of the upper 402 is not generally visible in FIG. 4.

According to additional features of the illustrated embodiment, the upper 402 is stitched to the heel and forefoot portions 445, 441 of the first and second insole boards 432 and 430, but the upper 402 is not stitched to the arch portion 443 of the insole 430. More specifically, the assembly 400 includes heel portion stitching 460 and forefoot portion stitching 462. The heel portion stitching 460 extends through each of the upper peripheral edge heel portion 452 and the first insole board 432. For example, the upper peripheral edge heel portion 452, which extends over or partially wraps inwardly around the bottom surface of the first insole board 432, before being sewn to the insole board with the heel portion stitching 460. In addition, the upper peripheral edge forefoot portion 456, which flares outwardly on the top surface of the second insole board 430, is sewn to the top surface of the insole forefoot portion 441 with the forefoot portion stitching 462. In at least one embodiment, the upper peripheral edge forefoot portion 456 can be wrapped around the edge of the insole board's forefoot portion, after being stitched to the top surface, and adhered to the bottom surface. At the arch portion 443 of the second insole board 430, however, the peripheral edge portion of the upper 402 is not sewn or stitched to the second insole board 430. Rather, the peripheral edge portion of the upper 402 can be glued or otherwise adhered to the second insole board 430 at the arch portion 443 of the insole 430.

From the foregoing, it will be appreciated that specific embodiments of the disclosure have been described herein for purposes of illustration, but that various modifications may be made without deviating from the spirit and scope of the disclosure. For example, although many of the Figures described above illustrate the midsoles and insoles as having multiple separate components, in other footwear assemblies the midsoles and insoles can include more or less components, including, for instance, integral or one-piece configurations. Further, while various advantages associated with certain embodiments of the disclosure have been described above in the context of those embodiments, other embodiments may also exhibit such advantages, and not all embodiments need necessarily exhibit such advantages to fall within the scope of the disclosure.

We claim:

1. A footwear assembly having an arch portion between a heel portion and a forefoot portion, the footwear assembly comprising:

an upper having a peripheral lower edge portion;

an insole adjacent to the upper, the insole including— a first insole board extending from the heel portion to the forefoot portion;

a heel counter adjacent to the first insole board and positioned at the heel portion; and a second insole board adjacent to the heel counter and positioned at the heel portion, the second insole board having a lower surface opposite the heel counter, and wherein the lower edge portion of the upper wraps around inwardly over at least a portion of the lower surface of the second insole board and directly to an upper surface of the forefoot portion of the first insole board;

stitching securing the lower edge portion of the upper directly to the lower surface of the second insole board;

a midsole coupled to the insole; and an outsole coupled to the midsole.

2. The footwear assembly of claim 1 wherein the lower edge portion of the upper is adhered to the insole or the midsole at the arch portion without being stitched thereto.

3. The footwear assembly of claim 1 wherein the stitching does not secure the lower edge portion of the upper to the first insole board at the heel portion.

4. The footwear assembly of claim 1 wherein the lower edge portion of the upper flares outwardly on the upper surface at the forefoot portion of the first insole board and does not wrap around the first insole board at the forefoot portion.

5. The footwear assembly of claim 1 wherein the midsole includes a first midsole component adjacent to the first insole board and positioned at the forefoot portion, and a second midsole component adjacent to each of the second insole board and the first midsole component, wherein the second midsole component extends from the heel portion to the forefoot portion.

6. The footwear assembly of claim 5 wherein the second midsole component includes an elevated support region in the heel portion that extends through at least a portion of the second insole board.

7. The footwear assembly of claim 1 wherein at the forefoot portion the stitching further secures the lower edge portion of the upper to each of the first insole board and the midsole.

8. The footwear assembly of claim 7 wherein the stitching is externally visible in the forefoot portion and the stitching is not externally visible in the heel portion.

9. The footwear assembly of claim 1 wherein the second insole board has a generally U-shaped configuration.

10. A footwear assembly comprising:

an upper having a forefoot portion and a heel portion;

an insole coupled to the upper, the insole having an upper surface opposite a lower surface, wherein the upper surface is configured to face a user's foot when inserted in the upper, and wherein the upper at least partially wraps around the lower surface at the heel portion and is stitched directly to the lower surface at the heel portion;

a midsole adjacent to the lower surface of the insole; and an outsole adjacent to the midsole;

wherein the insole comprises:

a first insole board extending from a heel portion to a forefoot portion of the upper, wherein the first insole board at least partially defines the upper surface of the insole;

a heel counter adjacent to the first insole board and positioned at the heel portion of the upper; and a second insole board adjacent to the heel counter and positioned at the heel portion of the upper, wherein the second insole board at least partially defines the lower surface of the insole.

11. The footwear assembly of claim 10 wherein the upper has an arch portion between the forefoot portion and the heel portion, and wherein the arch portion at least partially wraps around the lower surface at the heel portion and is adhered directly to the lower surface at the heel portion without being stitched thereto.

12. The footwear assembly of claim 11 wherein the forefoot portion of the upper is stitched directly to the upper surface of the insole.

13. The footwear assembly of claim 10 wherein the upper is stitched to the second insole board and the heel counter at the heel portion and not to the first insole board at the heel portion.

14. A method of manufacturing a footwear assembly, the method comprising:

coupling an upper to a sole assembly, the upper having a heel portion, a forefoot portion, and a peripheral lower edge portion, and the sole assembly having an insole and a midsole, wherein the insole is positioned between the upper and the midsole, and wherein coupling the upper to the sole assembly comprises— at the heel portion, stitching the lower edge portion of the upper to a lower surface of the insole facing the midsole; and at the forefoot portion, stitching the lower edge portion of the upper to an upper surface of the insole, wherein the upper surface of the insole is opposite the lower surface;

wherein the insole comprises:

a first insole component extending from the heel portion to the forefoot portion, the first insole component at least partially defining the second surface of the insole;

a second insole component adjacent to the first insole component and positioned at the heel portion; and a third insole component adjacent to the second insole component and positioned at the heel portion, the third insole component at least partially defining the first surface of the insole;

wherein stitching the lower edge portion of the upper to the first surface of the insole comprises stitching the lower edge portion of the upper to the third and second insole components, but not the first insole component.

15. The method of claim 14 wherein coupling the upper to the sole assembly further comprises not stitching the lower edge portion of the upper to the insole at an arch portion of the upper.

16. The method of claim 14 wherein coupling the upper to the sole assembly further comprises at least partially wrapping the lower edge portion of the upper around the lower surface of the insole at the heel portion.

17. The method of claim 14 wherein stitching the lower edge portion of the upper to the second surface of the insole at the forefoot portion further comprises stitching the lower edge portion of the upper to the midsole at the forefoot portion.

18. The method of claim 14 wherein the midsole comprises:

a first midsole component extending from the heel portion to the forefoot portion; and a second midsole component adjacent to the first midsole component and positioned at the forefoot portion;

wherein coupling the upper to the sole assembly comprises— at the forefoot portion, stitching the lower edge portion of the upper to the second midsole component; and at the heel portion, not stitching the lower edge portion of the upper to the first midsole component.

* * * * *